US009783351B2

(12) United States Patent
Bowman

(10) Patent No.: US 9,783,351 B2
(45) Date of Patent: Oct. 10, 2017

(54) SYSTEM, METHOD AND APPARATUS FOR GIFT BAG BINDING

(71) Applicant: The Lindy Bowman Company, Elkridge, MD (US)

(72) Inventor: Linden H. Bowman, Elkridge, MD (US)

(73) Assignee: The Lindy Bowman Company, Elkridge, MD (US)

( * ) Notice: Subject to any disclaimer, the term of this patent is extended or adjusted under 35 U.S.C. 154(b) by 0 days.

(21) Appl. No.: 15/192,319

(22) Filed: Jun. 24, 2016

(65) Prior Publication Data

US 2016/0304256 A1 Oct. 20, 2016

Related U.S. Application Data

(60) Division of application No. 13/900,917, filed on May 23, 2013, now Pat. No. 9,403,630, which is a continuation-in-part of application No. 12/851,170, filed on Aug. 5, 2010, now abandoned.

(51) Int. Cl.

| | |
|---|---|
| ***B65D 63/10*** | (2006.01) |
| ***B65D 33/14*** | (2006.01) |
| ***B65B 13/02*** | (2006.01) |
| ***B65B 13/24*** | (2006.01) |

(52) U.S. Cl.

CPC ..... *B65D 63/1027* (2013.01); *B65B 13/02* (2013.01); *B65B 13/24* (2013.01); *B65D 33/14* (2013.01); *Y10T 24/1402* (2015.01); *Y10T 29/49947* (2015.01)

(58) Field of Classification Search

CPC ..... B65B 13/02; B65B 13/24; B65D 33/14; B65D 63/0127; Y10T 24/1402; Y10T 29/49947

See application file for complete search history.

(56) References Cited

U.S. PATENT DOCUMENTS

| | | | | |
|---|---|---|---|---|
| 962,676 A | | 6/1910 | Snyder | |
| 1,810,027 A | | 6/1931 | Moran et al. | |
| 1,812,077 A | * | 6/1931 | Belash | G09F 1/10 40/124.4 |
| 2,125,246 A | | 7/1938 | Meyer | |
| 2,361,506 A | | 10/1944 | Gray et al. | |
| 3,628,708 A | | 12/1971 | Daughtry | |
| 3,874,034 A | | 4/1975 | Clayton | |
| 3,913,179 A | | 10/1975 | Rhee | |
| 4,093,288 A | | 6/1978 | Suzuki | |
| 4,280,811 A | | 7/1981 | Howe, Jr. | |

(Continued)

*Primary Examiner* — David Upchurch

(74) *Attorney, Agent, or Firm* — Cahn & Samuels, LLP

(57) ABSTRACT

An embodiment of the invention provides a method for attaching a plurality of gift bags together within a binding device, where a first gift bag strap of a first gift bag is secured to a first engaging member on a middle section of the binding device. The binding device includes a first crease between an upper section and the middle section, and a second crease between the middle section and a lower section. A second gift bag strap of a second gift bag is secured to a second engaging member on the middle section. The first engaging member is larger than the second engaging member, the first gift bag strap is larger than the second gift bag strap, and the first gift bag is larger than the second gift bag. The binding device is folded at the first crease and the second crease.

20 Claims, 9 Drawing Sheets

(56) References Cited

U.S. PATENT DOCUMENTS

| | | | | |
|---|---|---|---|---|
| 4,434,895 | A | 3/1984 | Voso et al. | |
| 4,466,159 | A | 8/1984 | Burrage | |
| 4,477,950 | A | 10/1984 | Cisek et al. | |
| 4,805,969 | A | 2/1989 | Heacock | |
| 4,942,644 | A | 7/1990 | Rowley | |
| 5,188,235 | A | 2/1993 | Pierce et al. | |
| 5,189,761 | A | 3/1993 | Chisholm | |
| 5,289,619 | A | 3/1994 | Pileggi | |
| 5,344,003 | A * | 9/1994 | Park | A47F 7/06 206/476 |
| 5,581,850 | A | 12/1996 | Acker | |
| 5,799,376 | A | 9/1998 | Harsley | |
| 5,878,520 | A | 3/1999 | Milbrandt et al. | |
| 6,131,200 | A | 10/2000 | McNamara | |
| 6,171,226 | B1 | 1/2001 | DeMatteis | |
| 6,283,312 | B1 | 9/2001 | Edgerton | |
| 6,467,132 | B1 | 10/2002 | Robley | |
| 6,591,460 | B1 | 7/2003 | Hoshino | |
| 6,763,554 | B1 | 7/2004 | Torrey et al. | |
| 6,889,999 | B2 | 5/2005 | Dominissini et al. | |
| 6,976,719 | B2 | 12/2005 | Agayof et al. | |
| 6,978,518 | B2 | 12/2005 | Kim | |
| 7,118,276 | B2 | 10/2006 | Clark | |
| 7,303,711 | B2 | 12/2007 | Gallant et al. | |
| 7,310,857 | B2 | 12/2007 | Kim | |
| 7,377,013 | B2 | 5/2008 | Cheung | |
| 2003/0111521 | A1 | 6/2003 | Holmes | |
| 2012/0160788 | A1 * | 6/2012 | Kopsak | A47F 11/06 211/59.2 |
| 2014/0061418 | A1 * | 3/2014 | Bowman | B65D 73/0064 248/342 |
| 2014/0150213 | A1 | 6/2014 | Bowman | |

* cited by examiner

SYSTEM, METHOD AND APPARATUS FOR GIFT BAG BINDING

This application is a divisional application of U.S. Ser. No. 13/900,917 filed on May 23, 2013 in the U.S. Patent and Trademark Office, which in turn claims priority to U.S. patent application Ser. No. 12/851,170 filed on Aug. 5, 2010, the entire contents of both applications are incorporated herein by reference.

I. BACKGROUND OF THE INVENTION

This invention relates to an improvement in gift bag packaging and particularly to binding and packaging gift bags for storage, display and transport.

II. DESCRIPTION OF THE TECHNICAL FIELD

In recent years, there has been a tremendous growth in the manufacture and sale of containers, particularly decorative containers for receiving and holding objects, such as gift objects. One form of such containers is a decorative bag that is adapted to receive a gift item, which eliminates the need to place the items in separate boxes that are usually subsequently wrapped with gift wrapping paper. Instead, gift items may be "wrapped" in the bag and hidden from view using such items as tissue paper, confetti, bag stuffing, shredded ribbons, and the like.

As these gift items are of varying sizes the decorative gift bags used to house these items are also of varying sizes. Typically these decorative or gift bags have ornamental designs on their surface containing indicia relating to a season, event or in some way relevant and/or endearing to the intended recipient of the gift. If decorative bags are sold or displayed as a unit, due to the varying sizes of these bags, it is difficult to package the bags in such a way that a plurality of varying size gift bags are securely bound and the ornamental design of a bag overlapping bags are visible to a consumer.

U.S. Pat. No. 7,377,013 issued to Cheung discloses an adjustable and detachable binding device that includes an elongated binding member, a plurality of locking holders spacedly and integrally formed along a tail portion of the binding member, and a loop locker integrally formed at a head portion of the binding member to detachably engage with one of the locking holders to form a binding loop of the binding member for fittingly binding up an object. The loop locker is shaped and sized that enables the loop locker to be detachably engaged with the respective locking holder, so as to adjust a diameter of the binding loop of the binding member with respect to the object.

U.S. Pat. No. 3,913,179 issued to Rhee discloses an adjustable, pliable tie strap comprising a series of longitudinal slot means at one end of the strap and a tongue portion at the opposite end containing notch means. The tongue portion can be inserted in any of the said slots for tying or securing an object.

U.S. Pat. No. 5,878,520 issued to Milbrandt, et al. discloses an advertising band for quick and easy locking, unlocking and re-locking about merchandise is a flexible strip having a lead end section, a body section, and a tail end section. The lead end section is equipped with a lock aperture having a maximum dimension in the longitudinal direction and a minimum dimension transverse thereto. The body section has a substantial length and transverse width for displaying advertising information. Its length is at least as great as the combined length of both the lead and the tail end sections. The tail end section has laterally paired locking members separated by neck members along its length. It is easily pulled through the aperture to lock any pair of the locking members against the minimum dimension edges of the aperture and yet is easily and quickly unlocked from the aperture by aligning its locking members with the maximum dimension of the aperture and pulling it free from the aperture.

U.S. Pat. No. 6,045,263 issued to Keller, et al. discloses a gift package that comprises a bag having generally parallel front and rear walls, each having a top edge, a bottom edge, and two lateral edges, a pair of generally parallel side walls, each having a top edge, a bottom edge, and two lateral edges, wherein the lateral edges of the front and rear walls are joined to the lateral edges of the side panels, and a bottom panel having two pairs of generally parallel lateral edges, wherein the lateral edges of the bottom panel are joined to the bottom edges of the front, rear, and side walls to form a container having an opening defined by the top edges of the front, rear, and side walls, and wherein the bag has an expanded state and a collapsed state, where an area of the bag opening is larger when the bag is in its expanded state than when the bag is in its collapsed state. The gift bag further comprises a bag topper comprising a resilient member having a length and a width, wherein the resilient member has a relaxed state and a compressed state, wherein the bag topper in the compressed state is smaller in at least one of the length and width than when the bag topper is in the relaxed state, so that the bag topper urges the opening of the bag toward the expanded state of the bag as the bag topper moves from the compressed state of the bag topper to the relaxed state of the bag topper.

III. SUMMARY OF THE INVENTION

It is an object of the present invention to provide means to efficiently bind and store a plurality of decorative gift bags.

It is another object of the present invention to provide a means to bind, package and display a plurality of gift bags of differing sizes where at least one of each size gift bag is visible in the display.

It is yet another object of the present invention to provide an apparatus for binding and packaging a plurality of gift bags of varying size for transport in an efficient self contained package.

It is still another object of the present invention to provide an apparatus for binding and packaging a plurality of gift bags that does not obstruct a design, logo or ornamental indicia incorporated on the outer surface of the gift bag.

It is another object of the present invention to provide an apparatus that allows the efficient packaging of a plurality of bound gift bags of varying size in a package no larger than the area defined by the largest gift bag of the plurality.

It is still yet another object of the present invention to provide an apparatus for binding and packaging a plurality of gift bags that is adjustable for different sized and/or different quantities of gift bags.

It is still another object of the present invention to provide an apparatus for binding a plurality of gift bags wherein the binding apparatus facilitates easily and efficient use in a retail display.

It is still another object of the present invention to provide an apparatus for binding a plurality of gift bags wherein the structure of the binding apparatus does not impede a shopper's view of the ornamental features of the bound collection of bags.

These and other objects of the invention are achieved in part by the disclosed adjustable binding device for attaching a plurality of decorative or gift bags together including a binding member, which has a length substantially longer than the body diameter of the largest of said plurality of gift bags being bound. The binding member includes a head end, an opposed tail, and an elongated body portion with two longitudinal edges. The head end, and a tail portion of the binding member include corresponding engagement apparatus disposed thereon to demountably fix the binding member's head end to the tail portion. A plurality of engaging members are spacedly formed along two longitudinal edges of the elongated body defining a plurality of corresponding sets of engaging steps on the binding member. Each of the engaging steps has a guiding edge and a locking edge inwardly and inclinedly extended from the respective longitudinal edge of the body portion of the binding member. The engaging steps of the binding member are disposed to engage at least one strap of a first gift bag of a plurality of gift bags and secure the first gift bag to a second overlapping gift bag of the plurality of gift bags engaged on a second step of said binding member. The engaging steps are disposed to orient the first and second gift bags to expose a portion of the body surface of the first gift bag and second overlapping gift bag.

Still other objects of the invention are achieved by the disclosed method for securing a plurality of gift bags having handles thereon for storage and display, including the steps of providing a binding member having a head end, an opposed tail, and an elongated body portion with two longitudinal edges; the head end, and a tail portion of said binding member having corresponding engagement apparatus disposed thereon to demountably fix the binding members head end to the tail portion. The binding member preferably has a plurality of engaging members spacedly formed along two longitudinal edges of said elongated body to define a plurality of sets of corresponding engaging steps on the binding member. Each of said engaging steps has a guiding edge and a locking edge inwardly and inclinedly extended from the respective longitudinal edge of the body portion of the binding member. The method also includes providing a plurality of gift bags, each of the gift bags having a handle portion attached to and a sack portion, defining a void in the space between the handle portion and sack portion, and inserting the binding member head through the void between the handle and the sack of a first bag of the plurality of gift bags.

The method also includes the step of engaging the handle of the first gift bag of the plurality of bags with a pair of engaging steps defined on the binding member positionally affixing the first gift bag on the elongated body.

The method also includes the step of inserting the binding member head through the void between the handle and the sack of at least a second bag of the plurality of gift bags and engaging the handle of at least a second gift bag of the plurality of gift bags with a pair of engaging steps defined on the binding member positionally affixing at least a second gift bag on the elongated body. The method also includes the step of wrapping the elongated body around the sack portion of each of the plurality of bags disposed in a stack, and engaging the corresponding engagement apparatus disposed on the head and tail portion of the binding member to demountably fix the binding members head end to the tail portion. As a result the first and at least a second bag is bound to the binding strip and suspended on pairs of engaging steps orienting the first and at least a second gift bag to expose a portion of the body surface of each gift bag.

For definitional purposes and as applicable the term "gift bag" as used herein is intended to mean any decorative bag, container, pouch and the like whether constructed of paper, plastic nylon or fabric having a sack portion and at least one strap, string, fabric, synthetic or paper handle disposed on said sack portion to facilitate carrying said bag.

As used herein "connected" includes physical, whether direct or indirect, permanently affixed or adjustably mounted. Thus, unless specified, "connected" is intended to embrace any operationally functional connection.

As used herein "substantially," "generally," and other words of degree are relative modifiers intended to indicate permissible variation from the characteristic so modified. It is not intended to be limited to the absolute value or characteristic which it modifies but rather possessing more of the physical or functional characteristic than its opposite, and preferably, approaching or approximating such a physical or functional characteristic.

As used herein, "proximate" is intended to mean near, adjacent, contiguous, next to, close to, by, on, in contact with, and the like.

In the following description, reference is made to the accompanying drawings which are shown by way of illustration to the specific embodiments in which the invention may be practiced. The following illustrated embodiments are described in sufficient detail to enable those skilled in the art to practice the invention. It is to be understood that other embodiments may be utilized and that structural changes based on presently known structural and/or functional equivalents may be made without departing from the scope of the invention.

IV. BRIEF DESCRIPTION OF THE DRAWINGS

V. DETAILED DESCRIPTION OF THE EMBODIMENTS

Referring now to the figures, wherein like reference numbers denote like components, elements, or features through the various illustrated embodiments discussed in detail below, the invention is an apparatus, system and method for the binding of a plurality of gift bags or the like for display, transportation, or storage. While specific implementations of the disclosed technology are discussed, it should be understood that this is done for illustration purposes only. A person skilled in the relevant art will recognize that other components and configurations may be used without departing from the spirit and scope of the invention.

Figure 1:
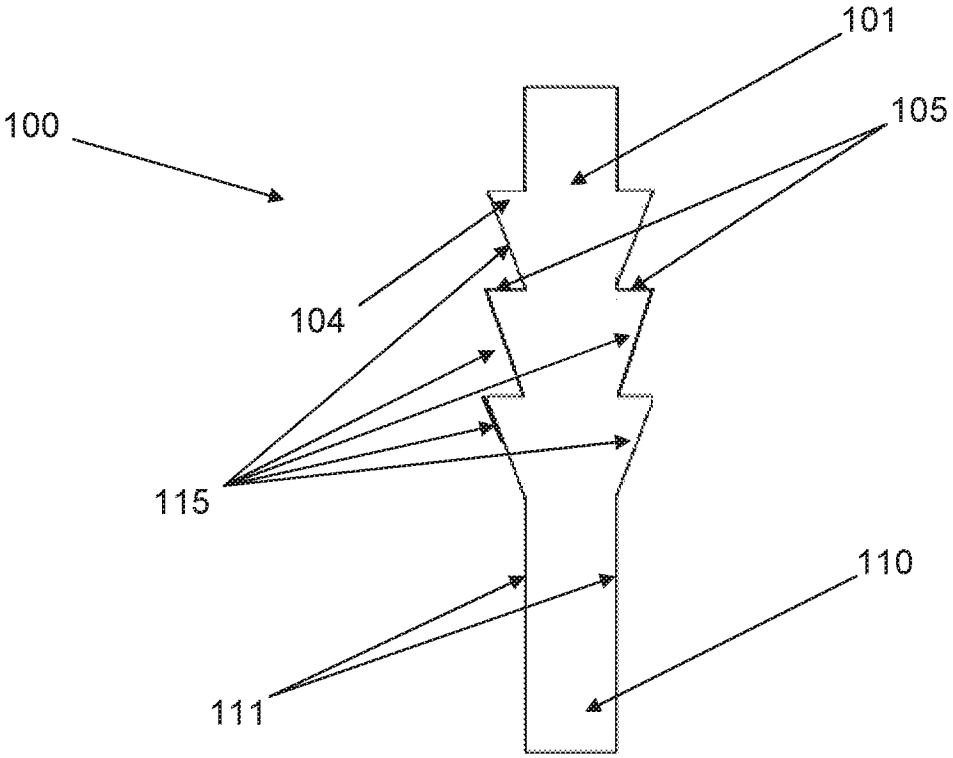
FIG. 1 illustrates the front view of an embodiment of the gift bag binding having a plurality of triangular shaped engaging steps for engaging gift bags.
Figure 2:
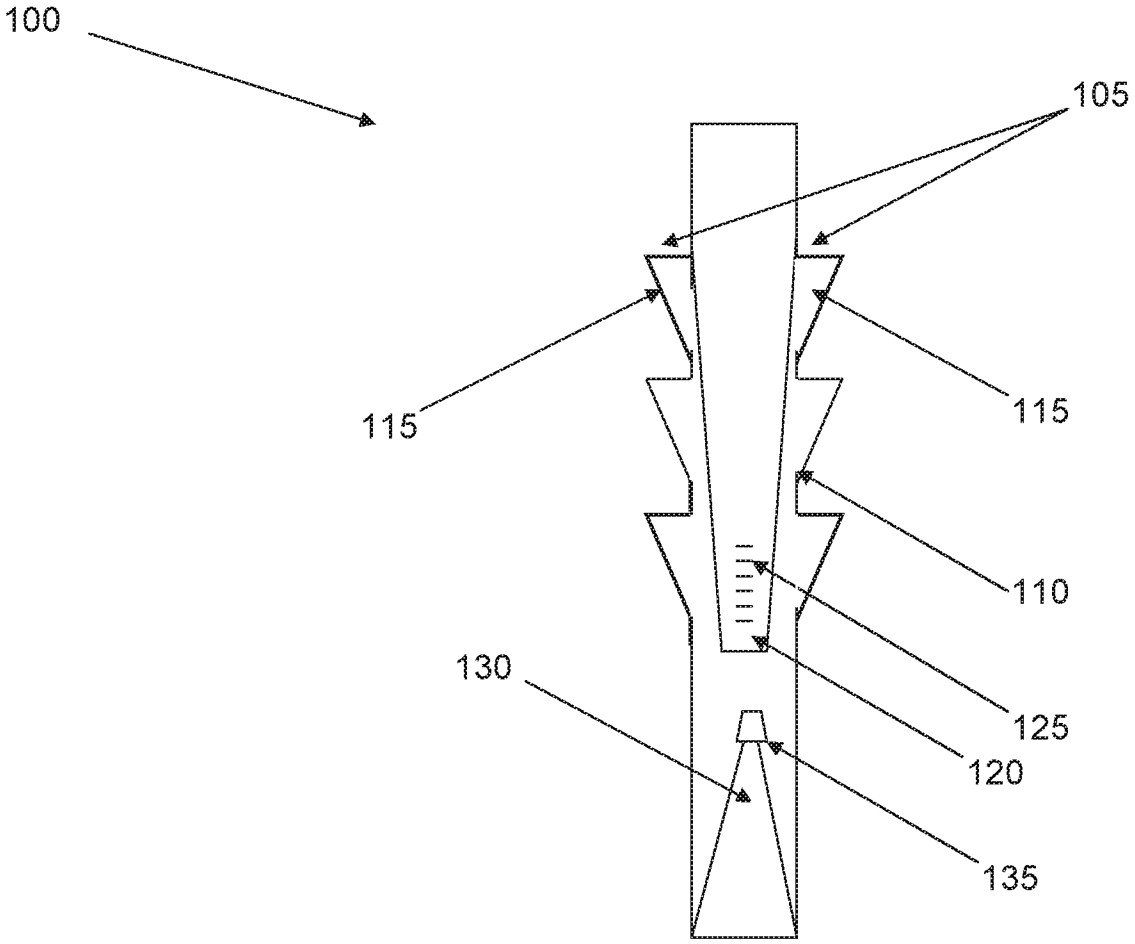
FIG. 2 illustrates the rear view of the embodiment of the gift bag binding in FIG. 1.

Turning now to the figures wherein like reference numbers denote like elements, FIG. 1 illustrates the front view of an embodiment of the gift bag binding having a plurality of triangular shaped steps for engaging gift bags. As illustrated in the figure, this embodiment of the inventive binding includes an adjustable binding 100 for attaching a plurality of gift bags together including a binding member 101, which has a length substantially longer than the body diameter of the largest of the plurality of gift bags being bound. Referring now to FIG. 2, illustrating the rear view, and with continued reference to FIG. 1, the binding member 101 has a head end 120, an opposed tail, 130 and an elongated body portion 110 with two longitudinal edges 111.

The head end 120, and a tail portion 130 of the binding member 101 have corresponding engagement apparatus disposed thereon 125, 135. The engagement apparatus 125, 135 disposed on the head end 120 and tail portion 130 are typically configured to demountably affix the binding member's head end 120 to the tail portion 130. The engagement apparatus may be in the form or Velcro, corresponding hook and loop, hook and slot, or other cooperating engagement apparatus known in the art. As shown in FIG. 2, the engagement apparatus of the embodiment shown features a hook 135 and a plurality of corresponding grooves or slots 125 sized and disposed to receive and engage the hook 135 and bind the head end 120 to the tail portion 130. The plurality of corresponding slots 125, are disposed at intervals on the head end 120 of the binding member 101 and facilitate adjustment of the size of the binding 100 to allow use with different sizes, and/or numbers of gift bags.

Figure 5:
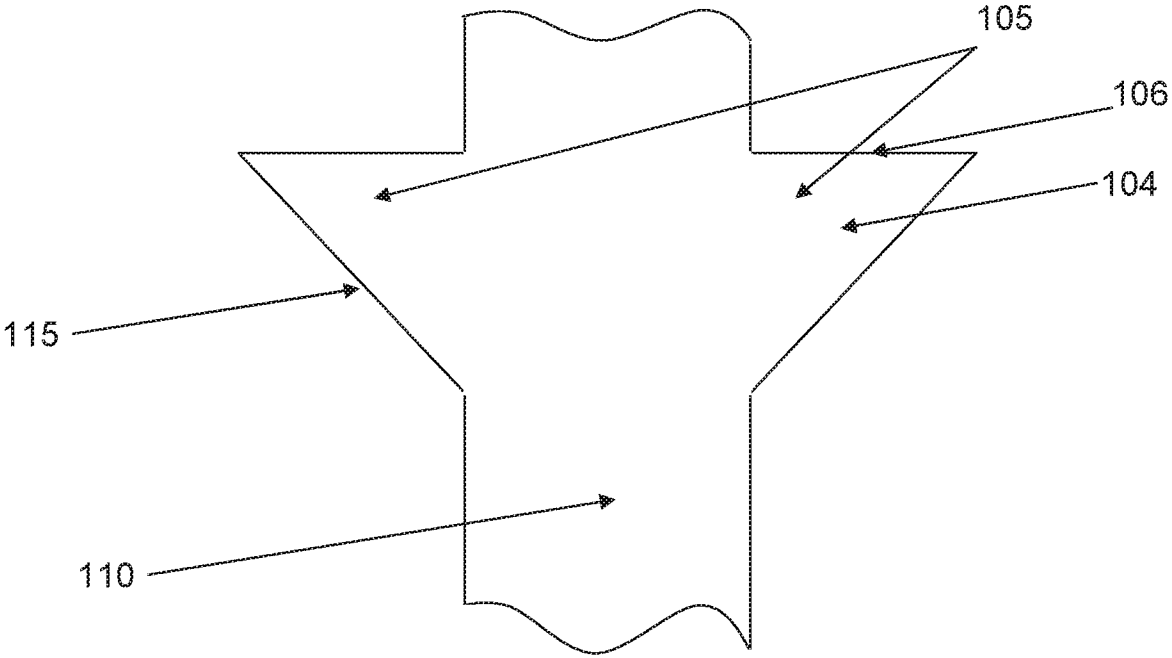
FIG. 5 illustrates a close up view of the engaging steps of the gift bag binding embodiment in FIG. 1.

A plurality of engaging members 104 are spacedly formed along two longitudinal edges 111 of the elongated body 110 and define a plurality of sets of corresponding engaging steps 105 on the binding member. FIG. 5 illustrates a close up view of the engaging members 104 disposed on the longitudinal edges 111 of the body 110.

As illustrated in FIG. 5 with continued reference to FIGS. 1 and 2, each of the engaging members 104 has a (supporting) locking edge 106 extending horizontally out from the elongated body 110, and a guiding edge 115 inwardly extended from the respective longitudinal 111 edge of the body portion 110 of the binding member 101.

Figure 3:
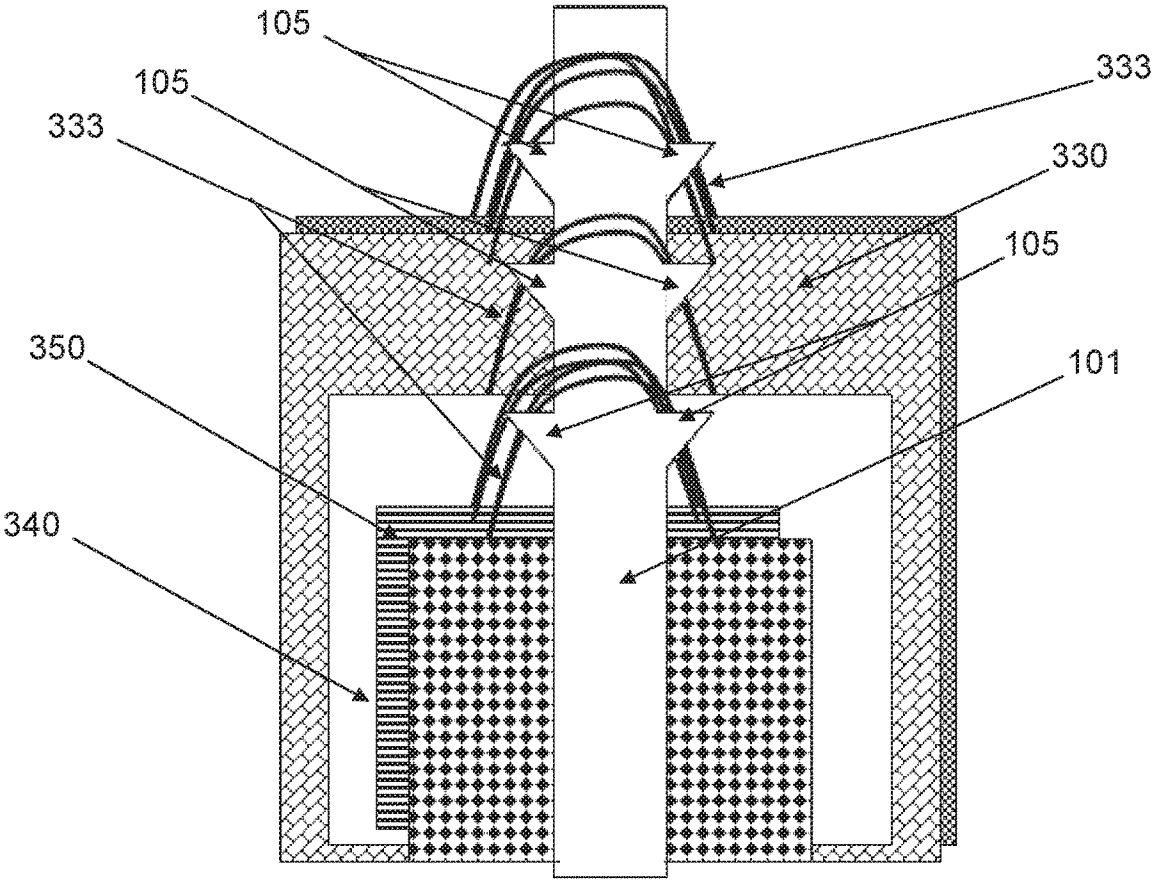
FIG. 3 illustrates the gift bag binding apparatus engaged and binding a plurality of decorative gift bags of varying sizes.

Referring now to FIG. 3, with continued reference to FIG. 1, the engaging steps 105 of the binding member 101 are sized and disposed to engage one or more straps 333 of a first gift bag 330 of the plurality of gift bags, and secures the first gift bag 330 to a second overlapping gift bag 350 of the plurality of gift bags on the binding member 101. The second overlapping gift bag 350 is engaged to a second step 105' of the binding member 101. The engaging steps 105 are typically sized and disposed to orient the first and second gift bags 330, 350 to expose a portion of the body surface of the first gift bag 330 and a portion of the body surface of the second overlapping gift bag 350.

A plurality of engaging steps are typically disposed at intervals along the elongated body 110 of the binding member 101 to accommodate several bag sizes. The intervals between the steps may be consistent or they may feature different spacing. In addition, the plurality of sets of corresponding engaging steps disposed on the body 110 of the binding member 100 may be of identical or differing sizes to further accommodate different sizes and different quantities of gift bags.

The guiding edge 115 of the engaging step 105 is preferably inclinedly extended from the respective longitudinal edge 111 of the body portion 110 of the binding member 101, however in other embodiments the guiding edge may be extended without a substantial inclined edge. Embodiments such as the one shown in FIG. 1 feature a gradually inclined edge. The gradual incline provides for positive seating and retention of each gift bag bound by the binding member. The positive seating retains or holds one or more gift bags in place on the binding.

Figure 4:
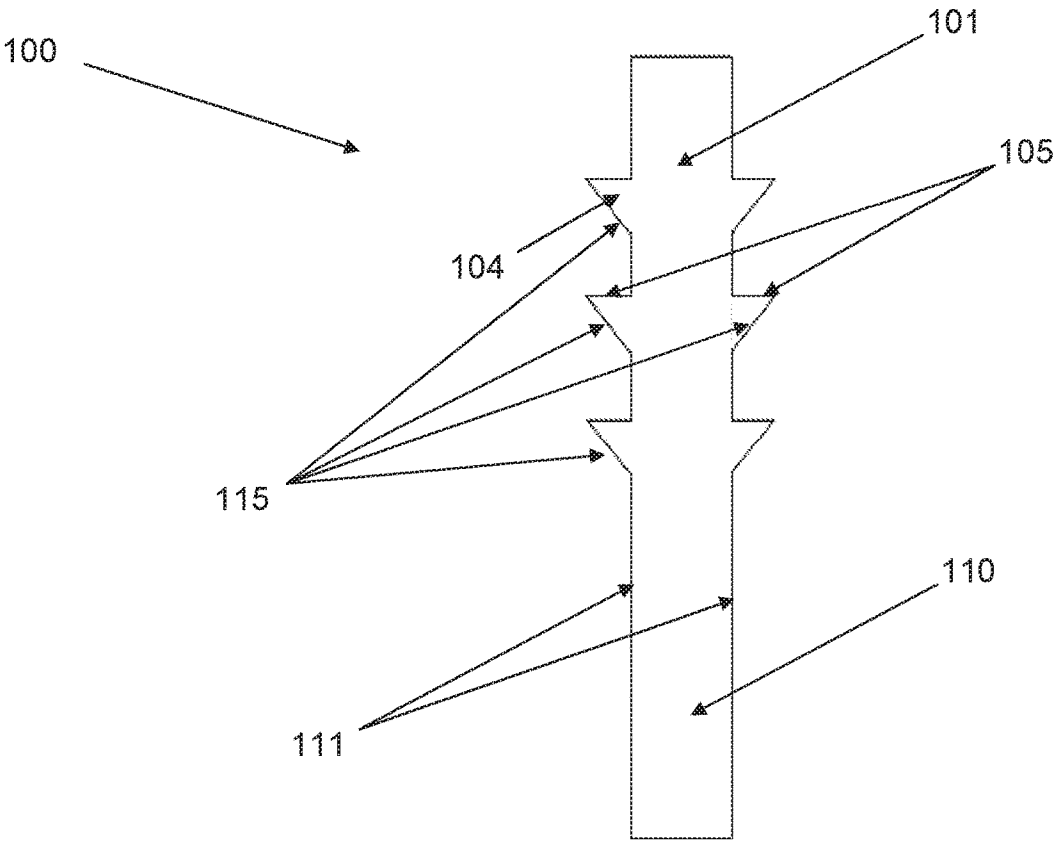
FIG. 4 illustrates a front view of another embodiment of the gift bag binding apparatus.
Figure 6:
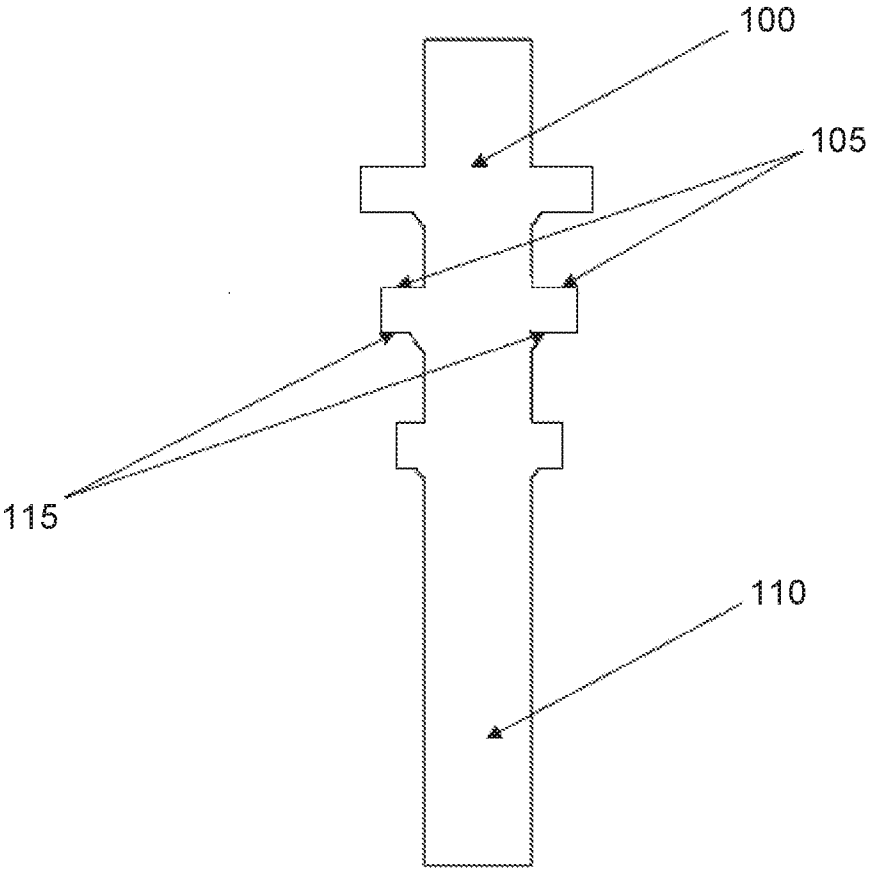
FIG. 6 illustrates an embodiment of the gift bag binding apparatus having a plurality of rectangular shaped steps for engaging gift bags.

FIG. 4 illustrates yet another embodiment of the gift bag binding apparatus. The embodiment of FIG. 4 features a guiding edge 115 of the engaging step 105 that is inclinedly extended from the respective longitudinal edge 111 of the body portion 110 of the binding member 101 at a greater angle than the embodiment shown in FIG. 1. This feature provides for a greater longer longitudinal edge 111 area and allows the bag binding to hold a greater number of gift bags and also allows the bags to be held in a looser configuration. An embodiment in which the guiding edge does not feature a substantially inclined edge in relation to the elongated body 110 is shown in FIG. 6.

Preferably the binding member 101 is constructed of a semi-rigid or flexible material. The binding member is preferably constructed of a transparent material, providing a largely unobstructed view of the bags that are bound therewith. The binding member's engagement apparatus may include Velcro, a tongue and a corresponding groove, adhesives or other engagement means. The corresponding engagement apparatus may disposed on either the head or the tail, or both and provide means to adjust the circumference of the binding to adjust and tailor the binding to engage gift bags of varying quantities, sizes and shapes.

Other embodiments of the invention disclose a method for securing a plurality of gift bags having handles thereon for storage and display. The method includes the steps of providing a binding member having a head end, an opposed tail, and an elongated body portion with two longitudal edges. The head end, and a tail portion of the binding member having corresponding engagement apparatus disposed thereon to demountably fix the binding members head end to the tail portion. The binding member includes a plurality of engaging members spacedly formed along two longitudinal edges of the elongated body, defining a plurality of sets of corresponding engaging steps on the binding member. Each of the engaging steps has a locking edge and a guiding edge inwardly extended from said respective longitudinal edge of said body portion of said binding member.

The method also includes inserting the binding member head through the void between the handle and the sack of a first bag of the plurality of gift bags and engaging the handle of the first gift bag of the plurality of bags with a pair of engaging steps defined on the binding member positionally affixing the first gift bag on the elongated body.

The method also includes the step of inserting said binding member head through the void between the handle and the sack of at least a second bag of the plurality of gift bags and engaging the handle of at least a second gift bag of the plurality of gift bags with a pair of engaging steps defined on the binding member positionally affixing at least a second gift bag on the elongated body.

The methods further includes wrapping the elongated body around the sack portion of each of the plurality of bags disposed in a stack and engaging the corresponding engagement apparatus disposed on the head and tail portion of the binding member to demountably fix the binding member's head end to the tail portion. The first and at least a second bag are bound to the binding strip and suspended on pairs of engaging steps orienting the first and at least a second gift bag to expose a portion of the body surface of each gift bag. In yet another embodiment the method also includes the step of inserting said binding member head through the void defined between the handle portion and the sack portion of a plurality of gift bags of different sizes and hanging the secured plurality of gift bags for display and adjusting the size of the binding member by changing the groove engaged by the corresponding tongue.

Figure 7:
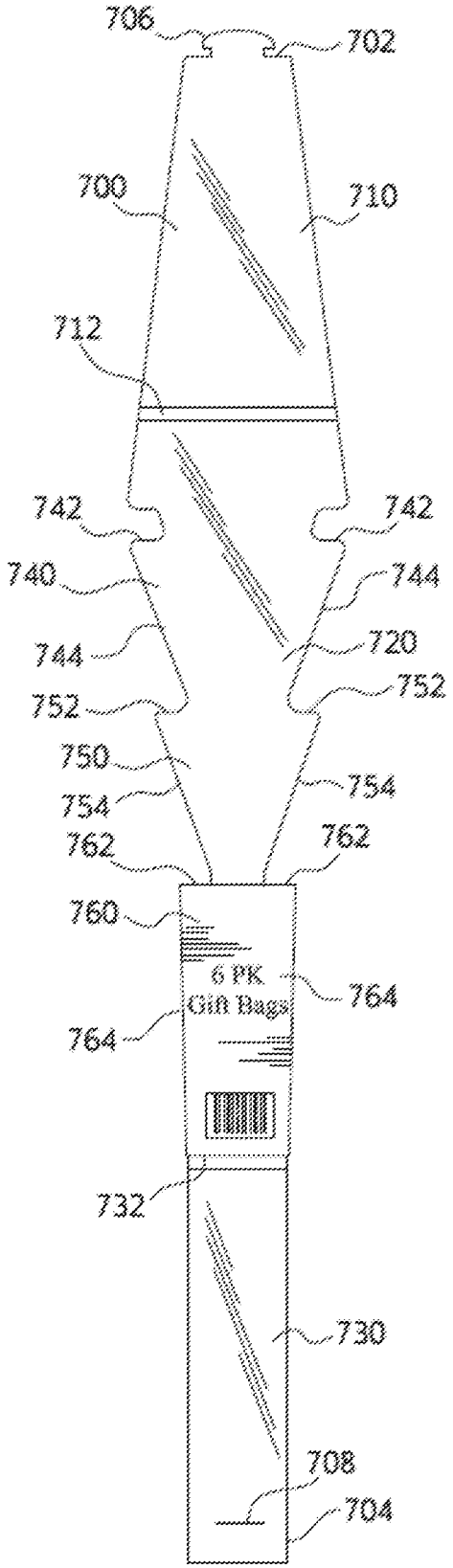
FIG. 7 illustrates a gift bag binding device according to an embodiment of the invention.

FIG. 7 illustrates a gift bag binding device for attaching a plurality of gift bags together according to an embodiment of the invention, wherein the binding device includes a body portion 700 having a first end 702, a second end 704 opposite the first end 702, an upper (back) section 710, a middle (front) section 720, and a lower (back) section 730. In at least one embodiment, the upper section 710 is trapezoidal shaped, i.e., has a trapezoidal shaped planar cross-section. The lower section 730 can be rectangular shaped, i.e., has a rectangular shaped planar cross-section.

A first fastener 706 (e.g., tab) is proximate the first end 702 of the body portion 700; and, a complementary second fastener 708 (e.g., slot) is proximate the second end 704, wherein the complementary second fastener 704 can releasably engage the first fastener 702. The body portion 700 further includes a first crease 712 and a second crease 732, wherein the first crease 712 is between the upper section 710 and the middle section 720, and wherein the second crease 732 is between the middle section 720 and the lower section 730. Folding the body portion 700 at the first crease 712 and the second crease 723 can bring the first fastener 706 in contact with the second fastener 708.

The middle section 720 includes a first engaging member 740 dimensioned to engage one or more first gift bag straps having a first size, and a second engaging member 750 dimensioned to engage one or more second gift bag straps having a second size different than the first size. In at least one embodiment, the first engaging member 740 is larger than the second engaging member 750. In another embodiment, the second engaging member 750 is larger than the first engaging member 740.

The first engaging member 740 includes locking edges 742 that extend horizontally out from the body portion 700, such that the locking edges 742 are parallel with the first crease 712 and the second crease 732. The first engaging member 740 further includes guiding edges 744 extending diagonally in from the locking edges 742 to the body portion 700.

The second engaging member 750 includes locking edges 752 that extend horizontally out from the body portion 700, such that the locking edges 752 are parallel with the first crease 712 and the second crease 732. The second engaging member 750 further includes guiding edges 754 extending diagonally in from the locking edges 752 to the body portion 700. As illustrated in FIG. 7, the locking edges 742 of the first engaging member 740 are larger than the locking edges 752 of the second engaging member 750.

Figure 8:
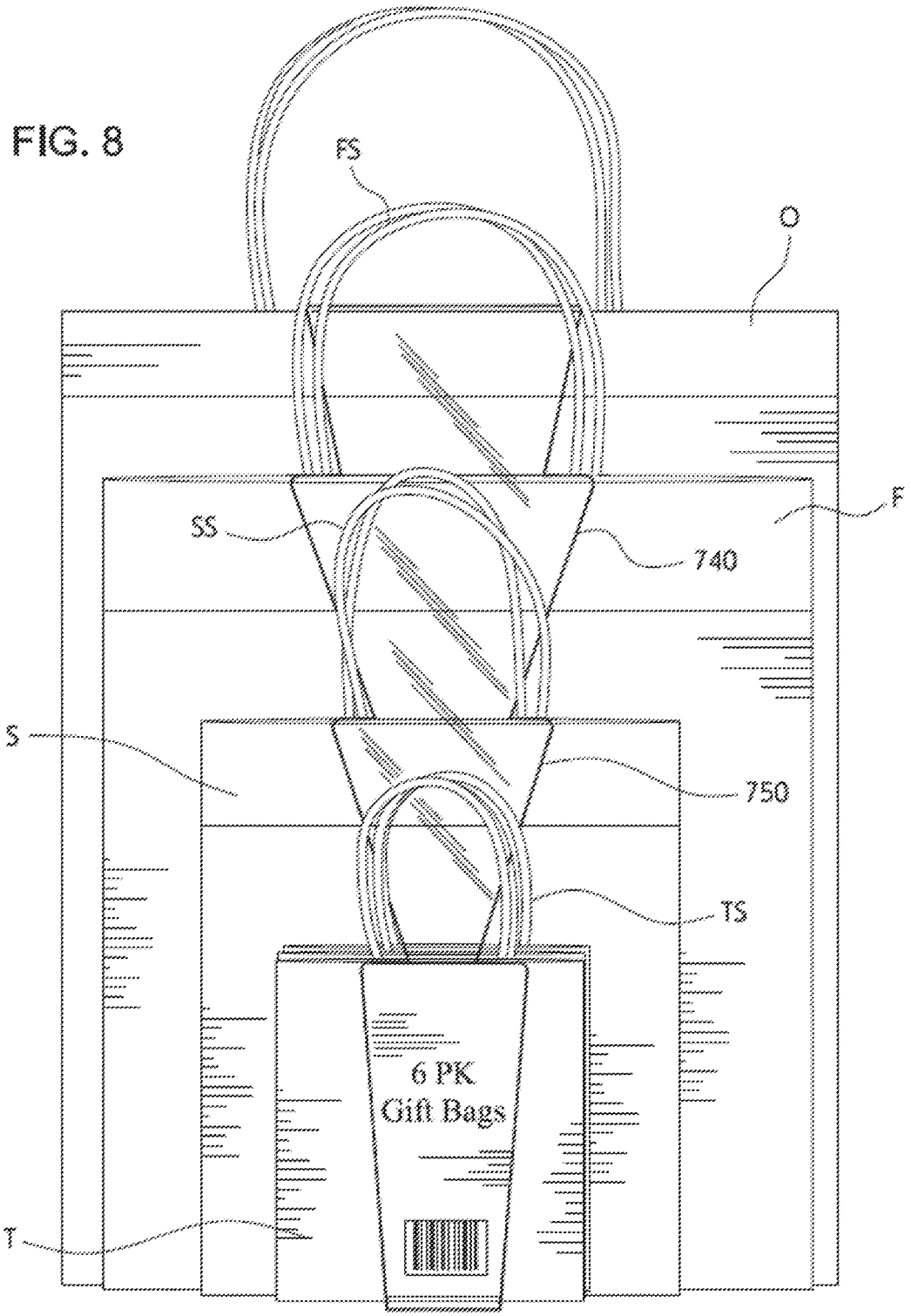
FIG. 8 illustrates the gift bag binding device of FIG. 7 attaching a plurality of gift bags together according to an embodiment of the invention.

As illustrated in FIG. 8, the first engaging member 740 secures a first gift bag F having the first gift bag strap FS to a second overlapping gift bag S having the second gift bag strap SS. The first engaging member 740 and the second engaging member 750 are disposed to orient the first and second gift bags to expose a portion of the body surface of the first gift bag F and a portion of the body surface of the second overlapping gift bag S.

The middle section 720 further includes a third (bottom) engaging member 760 including locking edges 762 to engage one or more third gift bag straps having a third size different than the first size and the second size. The third engaging member 760 includes the locking edges 762, two longitudinal edges 764, and the second crease 732. The locking edges 762 of the third engaging member 760 are smaller than locking edges 752 of the second engaging member 750; and, the locking edges 752 of the second engaging member 750 are smaller than the locking edges 742 of the first engaging member 740.

The first, second, and third engaging members 740, 750, 760 can each be trapezoidal shaped, i.e., having a trapezoidal shaped planar cross-section. The second engaging member 750 secures the second gift bag S having the second gift bag strap SS to a third overlapping gift bag T having the third gift bag strap TS. The first, second, and third engaging members 740, 750, 760 are disposed to orient the first, second, and third gift bags F, S, T to expose a portion of the body surface of the first gift bag F, a portion of the body surface of the second overlapping gift bag S, and the third overlapping gift bag T.

The first crease 712 is dimensioned to engage an upper edge of a fourth gift bag O; and, the second crease 732 is dimensioned to engage a lower edge of the fourth gift bag O to removably secure the fourth gift bag O within the binding device. The second crease 732 is also dimensioned to engage lower edges of the first gift bag F, the second gift bag S, and the third gift bag T. In at least one embodiment, the fourth gift bag O is larger than a first overlapping gift bag F, the first overlapping gift bag F is larger than the second overlapping gift bag S, the second overlapping gift bag S is larger than the third overlapping gift bag T.

Figure 9:
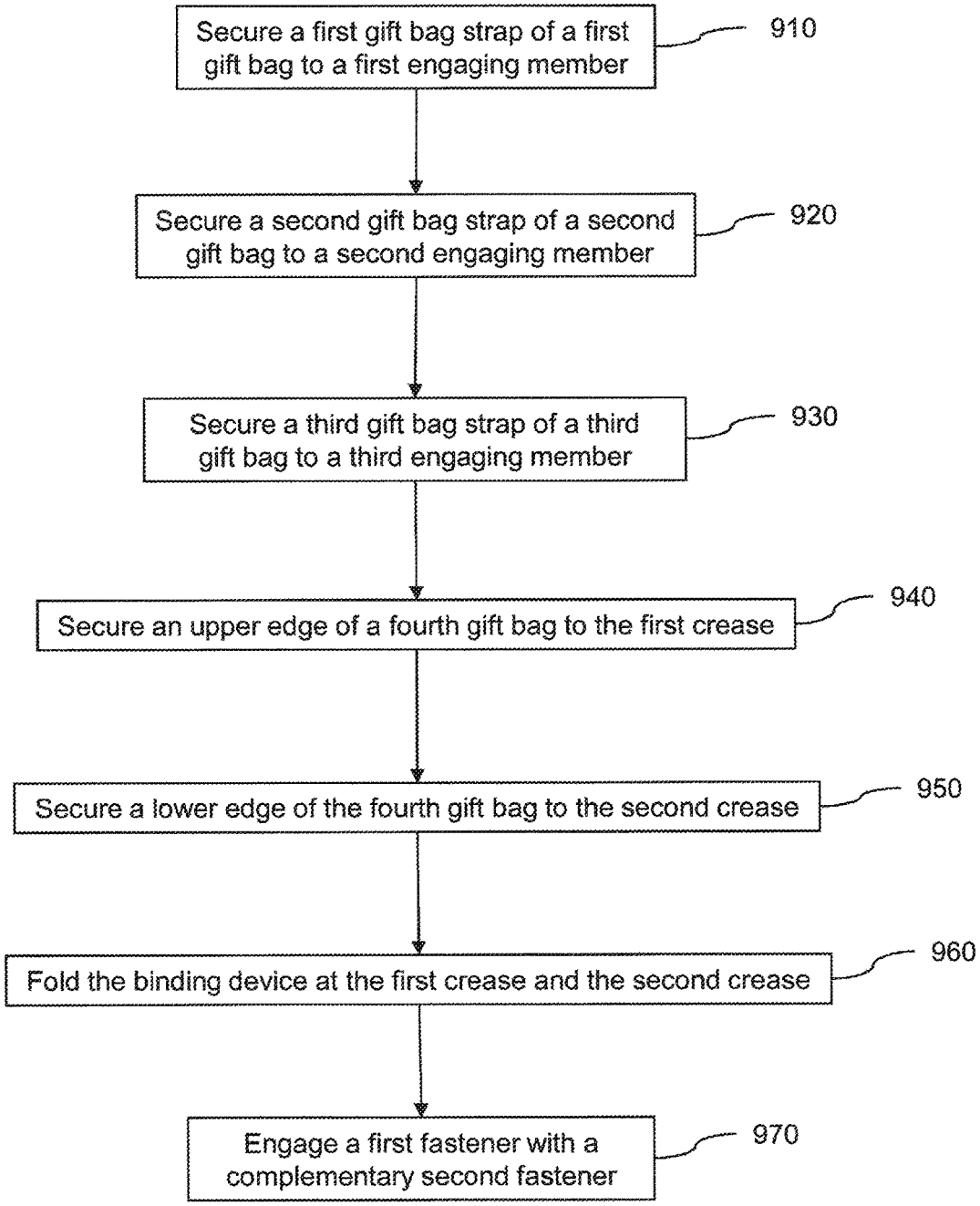
FIG. 9 is a flow diagram illustrating a method for attaching a plurality of gift bags together within a binding device according to an embodiment of the invention.

FIG. 9 is a flow diagram illustrating a method for attaching a plurality of gift bags together within a binding device according to an embodiment of the invention. A first gift bag strap of a first gift bag is secured to a first engaging member on a middle section of the binding device 910. The binding device can include a first crease between an upper section and the middle section, and a second crease between the middle section and a lower section.

A second gift bag strap of a second gift bag is secured to a second engaging member on the middle section 920. In at least one embodiment, the first engaging member is larger than the second engaging member, the first gift bag strap is larger than the second gift bag strap, and the first gift bag is larger than the second gift bag. The second gift bag can overlap the first gift bag such that a portion of the body surface of the first gift bag is exposed under the overlapping second gift bag. The second gift bag can be secured to the binding device before or after the first gift bag is secured to the binding device.

A third gift bag strap of a third gift bag is secured to a third engaging member on the middle section 930. In at least one embodiment, the second engaging member is larger than the third engaging member, the second gift bag strap is larger than the third gift bag strap, and the second gift bag is larger than the third gift bag. The third gift bag can overlap the second gift bag such that a portion of the body surface of the second gift bag is exposed under the overlapping third gift bag. The third gift bag can be secured to the binding device before or after the first and/or second gift bags are secured to the binding device.

An upper edge of a fourth gift bag is secured to the first crease 940; and, a lower edge of the fourth gift bag is secured to the second crease 950. The fourth gift bag can be larger than the first gift bag. The first gift bag can overlap the fourth gift bag such that a portion of the body surface of the fourth gift bag is exposed under the overlapping first gift bag. The fourth gift bag can be secured to the binding device before or after the first, second, and/or third gift bags are secured to the binding device.

The binding device is folded at the first crease and the second crease to bring the first end of the binding device in contact with the second end of the binding device 960. A first fastener proximate the first end is engaged with a complementary second fastener proximate the second end 970. The first and second fasteners can be engaged before or after the first gift bag, the second gift bag, the third gift bag, and/or the fourth gift bag is secured to the binding device.

Although specific example embodiments have been illustrated and described herein, those of ordinary skill in the art appreciate that other variations, aspects, or embodiments may be contemplated, and/or practiced without departing from the scope or the spirit of the appended claims, for example the disclosed apparatus may be used to organize and bind a plurality of shopping bags for display, storage or transport.

The invention claimed is:

1. A method for attaching a plurality of gift bags together within a binding device, said method comprising:

securing a first gift bag strap of a first gift bag to a first engaging member on a middle section of the binding device, the binding device comprising a first crease between an upper section and the middle section, and a second crease between the middle section and a lower section;

securing a second gift bag strap of a second gift bag to a second engaging member on the middle section, the first engaging member being larger than the second engaging member, the first gift bag strap being larger than the second gift bag strap, and the first gift bag being larger than the second gift bag;

folding the binding device at the first crease and the second crease to bring a first end of the binding device in contact with a second end of the binding device; and engaging a first fastener proximate the first end with a complementary second fastener proximate the second end.

2. The method according to claim 1, wherein said securing of the second gift bag strap to the second engaging member includes securing the second gift bag to the binding device such that the second gift bag overlaps the first gift bag, and such that a portion of the body surface of the first gift bag is exposed under the overlapping second gift bag.

3. The method according to claim 1, further comprising securing a third gift bag strap of a third gift bag to a third engaging member on the middle section, the second engaging member being larger than the third engaging member, the second gift bag strap being larger than the third gift bag strap, and the second gift bag being larger than the third gift bag.

4. The method according to claim 3, wherein said securing of the third gift bag strap to the third engaging member includes securing the third gift bag to the binding device such that the third gift bag overlaps the second gift bag, and such that a portion of the body surface of the second gift bag is exposed under the overlapping third gift bag.

5. The method according to claim 1, further comprising:

securing an upper edge of a fourth gift bag to the first crease; and securing a lower edge of the fourth gift bag to the second crease, the fourth gift bag being larger than the first gift bag.

6. The method according to claim 5, wherein said securing of the upper and lower edges of the fourth gift bag to the first and second creases of the binding device includes securing the fourth gift bag to the binding device such that the first gift bag overlaps the fourth gift bag, and such that a portion of the body surface of the fourth gift bag is exposed under the overlapping first gift bag.

7. A method for attaching a plurality of gift bags together within a binding device, said method comprising:

securing a first gift bag strap of a first gift bag to a first engaging member on a middle section of the binding device, the binding device comprising a first crease between an upper section and the middle section, and a second crease between the middle section and a lower section;

securing a second gift bag strap of a second gift bag to a second engaging member on the middle section, the first engaging member being larger than the second engaging member, the first gift bag strap being larger than the second gift bag strap, and the first gift bag being larger than the second gift bag, wherein said securing of the second gift bag strap to the second engaging member includes securing the second gift bag to the binding device such that the second gift bag overlaps the first gift bag, and such that a portion of the body surface of the first gift bag is exposed under the overlapping second gift bag;

folding the binding device at the first crease and the second crease to bring a first end of the binding device in contact with a second end of the binding device;

securing a third gift bag strap of a third gift bag to a third engaging member on the middle section, the second engaging member being larger than the third engaging member, the second gift bag strap being larger than the third gift bag strap, and the second gift bag being larger than the third gift bag; and engaging a first fastener proximate the first end with a complementary second fastener proximate the second end.

8. The method according to claim 7, wherein said securing of the third gift bag strap to the third engaging member includes securing the third gift bag to the binding device such that the third gift bag overlaps the second gift bag, and such that a portion of the body surface of the second gift bag is exposed under the overlapping third gift bag.

9. The method according to claim 7, further comprising:

securing an upper edge of a fourth gift bag to the first crease; and securing a lower edge of the fourth gift bag to the second crease, the fourth gift bag being larger than the first gift bag.

10. The method according to claim 9, wherein said securing of the upper and lower edges of the fourth gift bag to the first and second creases of the binding device includes securing the fourth gift bag to the binding device such that the first gift bag overlaps the fourth gift bag, and such that a portion of the body surface of the fourth gift bag is exposed under the overlapping first gift bag.

11. A method for attaching a plurality of gift bags together within a binding device, said method comprising:

securing a first gift bag strap of a first gift bag to a first engaging member on a middle section of the binding device, the binding device comprising a first crease between an upper section and the middle section, and a second crease between the middle section and a lower section;

securing a second gift bag strap of a second gift bag to a second engaging member on the middle section, the first engaging member being larger than the second engaging member, the first gift bag strap being larger than the second gift bag strap, and the first gift bag being larger than the second gift bag;

folding the binding device at the first crease and the second crease to bring a first end of the binding device in contact with a second end of the binding device; and securing a third gift bag strap of a third gift bag to a third engaging member on the middle section, the second engaging member being larger than the third engaging member, the second gift bag strap being larger than the third gift bag strap, and the second gift bag being larger than the third gift bag.

12. The method according to claim 11, engaging a first fastener proximate the first end with a complementary second fastener proximate the second end.

13. The method according to claim 11, wherein said securing of the second gift bag strap to the second engaging member includes securing the second gift bag to the binding device such that the second gift bag overlaps the first gift bag.

14. The method according to claim 11, wherein said securing of the second gift bag strap to the second engaging member includes securing the second gift bag to the binding device such that a portion of the body surface of the first gift bag is exposed under the overlapping second gift bag.

15. The method according to claim 11, wherein said securing of the third gift bag strap to the third engaging member includes securing the third gift bag to the binding device such that the third gift bag overlaps the second gift bag.

16. The method according to claim 11, wherein said securing of the third gift bag strap to the third engaging member includes securing the third gift bag to the binding device such that a portion of the body surface of the second gift bag is exposed under the overlapping third gift bag.

17. The method according to claim 11, further comprising securing an upper edge of a fourth gift bag to the first crease.

18. The method according to claim 17, further comprising securing a lower edge of the fourth gift bag to the second crease, the fourth gift bag being larger than the first gift bag.

19. The method according to claim 18, wherein said securing of the upper and lower edges of the fourth gift bag to the first and second creases of the binding device includes securing the fourth gift bag to the binding device such that the first gift bag overlaps the fourth gift bag.

20. The method according to claim 18, wherein said securing of the upper and lower edges of the fourth gift bag to the first and second creases of the binding device includes securing the fourth gift bag to the binding device such that a portion of the body surface of the fourth gift bag is exposed under the overlapping first gift bag.

* * * * *